United States Patent [19]

Williams

[11] Patent Number: 4,767,066

[45] Date of Patent: Aug. 30, 1988

[54] DOWNDRAFT REVERSIBLE HAMMER MILL

[75] Inventor: Robert M. Williams, Ladue, Mo.

[73] Assignee: Williams Patent Crusher and Pulverizer Company, St. Louis, Mo.

[21] Appl. No.: 40,101

[22] Filed: Apr. 20, 1987

Related U.S. Application Data

[63] Continuation-in-part of Ser. No. 899,806, Aug. 25, 1986, abandoned.

[51] Int. Cl.[4] ..... B02C 13/288

[52] U.S. Cl. ..... 241/27; 291/189 A; 291/190

[58] Field of Search ..... 241/189 R, 33, 189 A, 241/37, 73, 186 R, 186.3, 27, 190, 30, 88.4

[56] References Cited

U.S. PATENT DOCUMENTS

| | | | |
|---|---|---|---|
| 1,751,009 | 3/1930 | Liggett . | |
| 2,767,929 | 10/1956 | West . | |
| 3,083,921 | 4/1963 | Danyluke et al. . | |
| 3,610,543 | 10/1971 | Jensen | 241/190 X |
| 3,667,694 | 6/1972 | Williams . | |
| 4,009,836 | 3/1977 | Strom et al. . | |
| 4,049,206 | 9/1977 | Konig et al. | 241/190 X |

OTHER PUBLICATIONS

Bulletin of the Pennsylvania Crusher Division, 10-1962.

*Primary Examiner*—Mark Rosenbaum
*Attorney, Agent, or Firm*—Gravely, Lieder & Woodruff

[57] ABSTRACT

A downdraft reversible hammer mill having a casing structure for rotatably supporting a hammer assembly between a top inlet and a bottom outlet, breaker plates pivoted near the top inlet and extending down on opposite sides of the circular path of the hammer assembly, grate bars circumscribing the hammer assembly and having opposite end grate bars extending into cooperative relation with the bottom ends of the breaker plates, such that by controlling the positions of the breaker plates relative to both the circular path of the hammer assembly and the end grate bars, with one breaker plate moved in adjacent the circular path and the opposite breaker plate moved back from the circular path to open the cooperating end grate bar, the mill is caused to operate with a negative pressure at the inlet and a positive pressure at the outlet to establish a downdraft effect in the mill casing structure in either direction of hammer assembly of rotation upon properly positioning one breaker plate moved in and the opposite breaker plate moved out. The breaker plates are provided with teeth positioned for shredding the plastic bags that contain trash to prevent blinding the mill by such bags that tend to cling to the hammers.

9 Claims, 2 Drawing Sheets

DOWNDRAFT REVERSIBLE HAMMER MILL

REFERENCE TO THE PRIOR APPLICATION

This application is related to, contains subject matter in common with, and is a continuation-in-part of Ser. No. 899,806, filed Aug. 25, 1986 entitled DOWNDRAFT REVERSIBLE HAMMER MILL, now abandoned.

BACKGROUND OF THE INVENTION

1. Field of the Invention

This invention relates to reversible hammer mills and more particularly to such mills having provision for preventing dust issuing from the material feed inlet by restricting the fan effect of the mill rotor to one in which there is a downdraft through the mill regardless of rotor rotation.

2. Description of the Prior Art

The prior art relating to downdraft type mills includes the patents of Liggett U.S. Pat. Nos. 1,751,009 of Mar. 18, 1930 and West 2,767,929 of Oct. 23, 1956. In these two examples, there is provided means for preventing the escape of dust and fine material through the feed inlet. Such prevention is needed to force the fan effect of the mill rotor to create a "downdraft" in the mill casing. The prior art patent of Danyluke et al U.S. Pat. No. 3,083,921 of Apr. 2, 1963 is an example of dust prevention means applied to a reversible rotary impactor mill, which is intended to produce a negative air pressure at the delivery exit thereby developing a positive pressure at the inlet to allow for an updraft in the inlet.

Another prior art form of inhibiting the escape of dust through a mill feed inlet is seen in a Bulletin of the Pennyslvania Crusher Division, Bath Iron Works Corporation, West Chester, Pa., page 9, FIG. 13. The Bulletin bears the date 1041-62 (meaning 1962).

SUMMARY OF THE INVENTION

The present preferred embodiment of the invention resides in an arrangement of breaker plates and grate bars such that the fan effect of the rotor hammers in the mill casing is caused to create a downdraft flow between the lower end of the breaker plate and the adjacent grate bar.

The primary object of the invention is to provide a draft opening from the mill rotor chamber into the mill outlet beyond the grate bars, thus inhibiting the blow back of dust and particulate matter through the material feed inlet.

Another important object of the present invention is to provide in a downdraft hammer mill means for shredding sheet and plastic material that is fed to the mill and if not shredded would blind the mill downdraft function.

A further object of the invention is to provide for the positioning of the breaker plates relative to the adjacent grate bars so that the downdraft effect is available in a reversible type hammer mill.

BRIEF DESCRIPTION OF THE DRAWINGS

The present reversible hammer mill is shown in the accompanying drawings, wherein.

DETAILED DESCRIPTION OF THE EMBODIMENT

Figure 1:
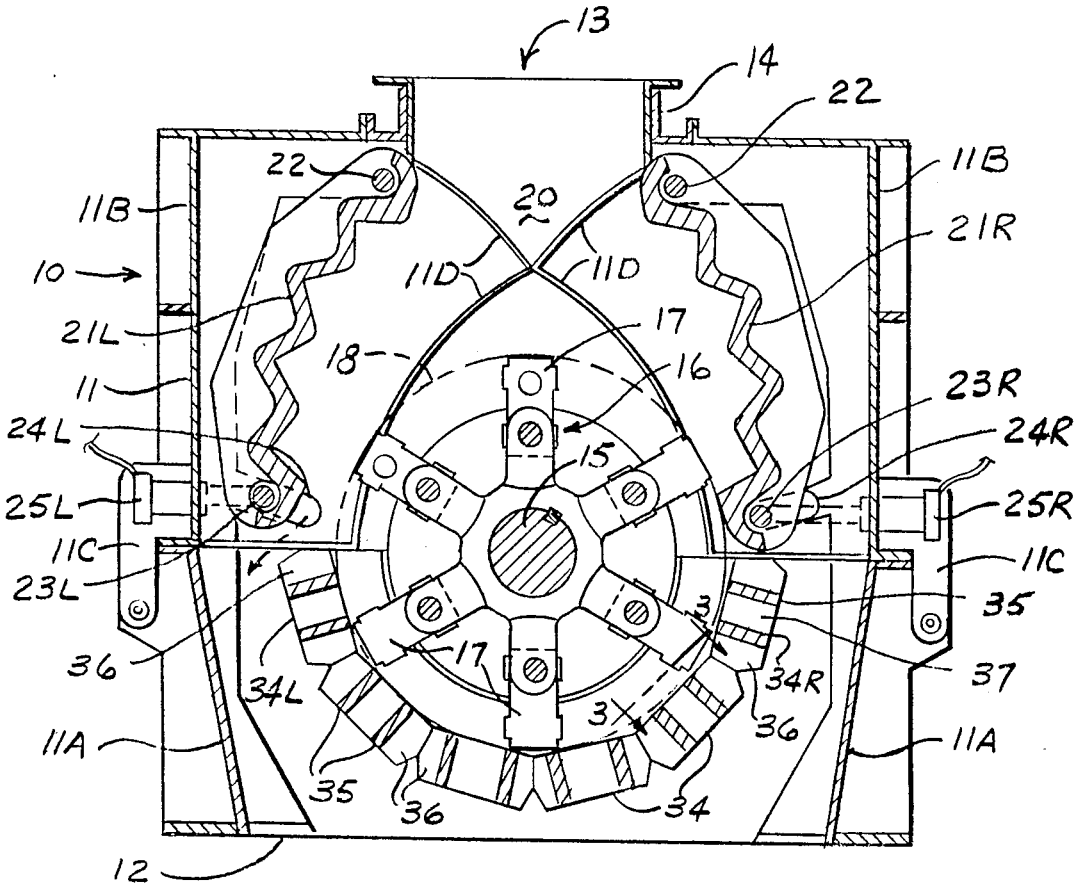
FIG. 1 is a vertical sectional view of a reversible hammer mill to illustrate the arrangement of the breaker plates, grate bars, center material feeding mill casing, and means for swinging the breaker plates into desired positions to allow for reversibility of the rotor.

With reference to FIG. 1 there is seen a sectional elevational view of a typical hammer mill assembly 10 having a suitable casing 11 formed with a bottom opening 12 defined by and between lower wall portions 11A of the casing 11, and provided with an inlet opening 13 defined by the guide structure 14 which is centrally located and in vertical alignment with the drive shaft 15 on which a rotary hammer assembly 16 is carried. The hammer elements 17 are pivotally connected to the assembly 16 and when the shaft 15 is rotated the hammer tips define a circular path of travel 18.

The inlet 13 of the mill casing 11 opens into a feed area 20 defined by and between a right hand breaker plate 21R and a left hand breaker plate 21L. The respective breaker plates are commonly mounted at their upper ends on pivot shafts 22 located in position relative to the inlet guide structure 14 so that the entry of material into the feed area 20 will be prevented from passing around the upper ends of the breaker plates 21R and 21L and getting into the space in the casing behind those breaker plates.

The mill casing 11 is constructed to have similar right and left casing sections 11B pivotally connected by suitable hinges 11C to the lower wall portions 11A of the casing 11. Each casing section 11B is formed with parting joints 11D such that on opening the casing the right and left breaker plates 21R and 21L are swung with the sections 11B out of the way to provide easy access to the rotary hammer assembly 16. Each casing section 11B carries with it, on being opened about the externally mounted hinges 11C, the breaker plates and operating means referred to as follows:

The lower or terminal end of the right breaker plate 21R receives a shaft 23R which extends across the width of the casing 11 and projects through the side wall at a slot 24R so that movement of the breaker plate 21R about its upper pivot shaft 22 moves along the slot 24R from the inner end of such a slot toward the outer end thereof. On the left hand side of the mill casing 11 the breaker plate 21L is similarly provided at its lower or terminal end with a shaft 23L that extends through the casing 11 so as to be able to move within the slot 24L as between the inner and outer ends of that slot. The right hand breaker plate shaft 23R is connected at one of its outwardly projecting ends to a hydraulic cylinder or other suitable drive means 25R, and the left hand breaker plate 21L is also operatively connected to a suitable drive means 25L which may be a fluid pressure cylinder or other suitable drive means for moving the shaft 23L along the slot 24L.

Figure 2:
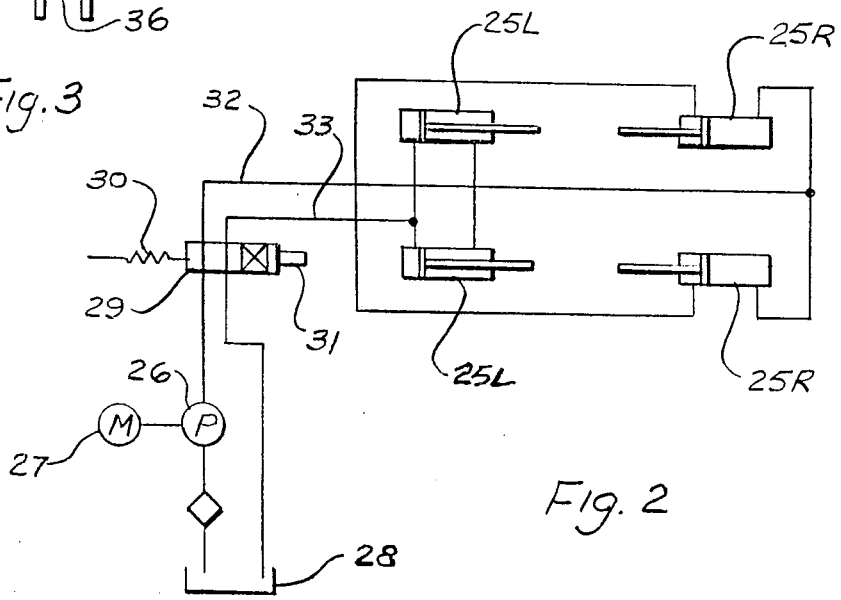
FIG. 2 is a schematic view of means for controlling the positions of the breaker plates to create the desired downdraft at the mill outlet.

Turning now to FIG. 2, there is shown a schematic view of fluid pressure control means normally situated adjacent the mill 10 and connected up by flexible conduits for effecting the movement of the breaker plates 21R and 21L. It is understood, of course, that the shafts 23R and 23L extend through the opposite side walls of the mill casing 11 to the exterior thereof so that the cylinder means 25R and 25L may be suitably connected to the opposite ends of the shafts 23R and 23L for simultaneous movement of the respective breaker plates. In the view of FIG. 2 a hydraulic pump 26 driven by a motor 27, receives pressure fluid from a supply reservoir 28 and delivers the same through a reversing valve 29 which is responsive in one setting to a spring 30 and in an opposite setting to the energization of a solenoid 31. In this way, the supply ccnduit 32 and return conduit 33 can be reversed in function so that as one pair of cylinders 25R is energized to advance a breaker plate 21R toward the hammer circle 18 of the rotor assembly, the opposite pair of cylinders 25L are caused to move the breaker plate 21L back from the hammer circle 18. The respective positions of the breaker plates 21R and 21L are indicated in full line in FIG. 1, while the opposite setting with the breaker plate 21R withdrawing and the breaker plate 21L advanced, is understood to be opposite. It is understood in the schematic view of FIG. 2 that the solenoid 31 may be energized or deenergized as desired so as to shift the valve against the spring 30 or to allow the spring 30 to shift the valve for the purpose of simultaneously moving the breaker plates to one of the described positions.

Figure 3:
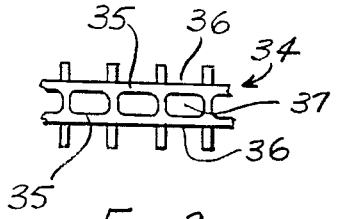
FIG. 3 is a fragmentary view of a typical grate bar as seen along line 3—3 in FIG. 1.

Returning to FIG. 1, it is seen that the rotary hammer assembly 16 is partially circumscribed along the hammer circle 18 below the rotary drive shaft 15 by a series of grate bars 34. One of the bars 34R is in a position to be cooperative with the lower end of the right hand breaker plate 21R, and an opposite grate bar 34L is in a position to cooperate with the breaker plate 21L. It is important in the present disclosure to recognize that each of the grate bars 34R and 34L, as well as the intermediate bars 34 (see FIG. 3) are constructed to have spaced ribs 35 so arranged as to form each of the grate bars with side open passages 36 and a central passage 37. Passages 36 and 37 are sized to allow material that has been suitably reduced by the action of the hammer elements 17 to pass through and exit from the casing 11 at the open bottom 12.

For purposes of the following description, it is to be assumed that the breaker plate 21R, which has been moved inwardly by the cylinders 25R, has its lower end positioned adjacent the grate bar 34R and also close to the hammer circle 18. Under this setting of the breaker plate 21R the hammer assembly is intended to rotate in a counterclockwise direction so that the fan effect of the hammers carries the material entering the inlet 13 and in the feed area 20 down past the retracted end of the left hand breaker plate 21L. While the material may not be of a size to pass through the openings in the breaker bar 34L, the air in such material is free to pass out through the end openings of the breaker bar 34L and into the outlet of the mill casing 12. At the right hand side of the assembly, the inward movement of the breaker plate 21R is very close to the hammer circle 18 so that air flow is pinched off and resists being impelled upwardly through the feed area 20 to cause an updraft at the inlet 13. What is happening during the counterclockwise rotation of the hammer assembly is that a negative pressure condition is created in the feed area 20 so that the air flow is sucked into the mill casing 11 and impelled outwardly through the open bottom end 12 of the mill casing. It is understood that when the breaker plate 21R is moved away from or retracted relative to the hammer circle 18, and the left hand breaker plate 21L is moved close into the hammer circle 18, the hammer assembly 16 must be rotated in a clockwise direction in order that the reverse fan effect can duplicate the downdraft effect where the pressure in the feed area 20 has a negative value and pressure at the casing opening 12 is positive.

The foregoing description describes the means which is operably connected to the breaker plates 21R and 21L to position the terminal ends thereof relative to the cooperating ends of the grate means 35 and 36 such that a terminal end of one breaker plate is spaced from a cooperating end of the grate means to open an air flow passage around the grate means while the terminal end of the opposite breaker plate is closed down on a cooperating end of the grate means to pinch off an air flow passage around the grate means, such that the spaced ends allow air flow therethrough from the casing inlet and the closed down end restricts air flow therethrough toward the casing inlet for drive shaft rotation of the hammers to produce the air moving fan effect toward the opening air flow pasasge around the grate means.

It should now be apparent that the present embodiment of the invention relates to a downdraft reversible hammer mill 10 having a casing 11 formed with a centrally located material inlet 13 and an opposite bottom outlet 12, a rotary hammer assembly 16 operably mounted in the casing so it can rotate in either direction and can describe a circular path 18 of hammer assembly travel, an assembly of a plurality of grate bars 34 circumscribing the circular path 18 of the hammer assembly 16 in a generally semi-circular manner, and breaker plates 21R and 21L spaced apart and having pivots 22 at the upper ends adjacent the casing inlet 13 and lower terminal ends to cooperate with the adjacent grate bar ending bars 34R and 34L. In such an embodiment, the improvement comprises the grate bars 34R and 34L at each end of the grate bar assembly being positioned adjacent the lower or terminal ends of the breaker plates 21R and 21L and being formed with flow passages 36 communicating between the bottom outlet 12 and the circular path of travel 18 of the hammer assembly; cylinder means 25R and 25L are operably connected to the respective breaker plates for pivotally moving the terminal ends such that one terminal end closes upon the circular path 18 of the hammer assembly, and the terminal end of the opposite breaker plate is moved in a direction away from the circular path 18 of travel of the hammer assembly, whereby the direction of rotation of the hammer assembly downwardly toward the breaker plate moved away from the circular path of the hammer assembly creates a negative pressure in the casing adjacent the inlet 13 to effect a downdraft flow or fan effect of the hammer assembly toward the bottom outlet 12. Thus, the dust and related fine material is prevented from issuing at the inlet 13.

While FIG. 2 is a schematic view of means for concurrently controlling the positions of the breaker plates 21R and 21L relative to the grate bars 34R and 34L and to the hammer circle 18, it is understood that positional adjustment of these breaker plates may be effected by resort to mechanically adjusted mechanism disclosed in my earlier U.S. Pat. No. 3,637,145, assuming, of course, that the direction of rotation of the hammer assembly on shaft 15 is properly selected in accordance with the foregoing disclosure.

Figure 4:
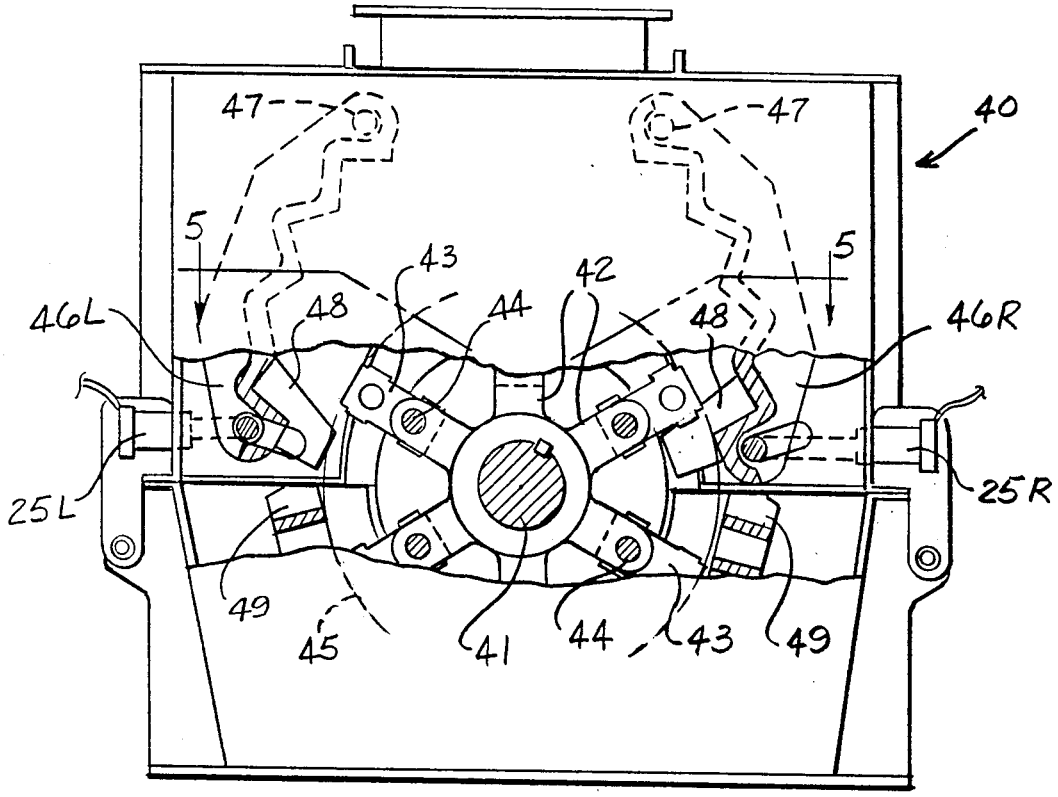
FIG. 4 is a sectional view similar to FIG. 1 in which provision is made for shredding sheet and plastic material fed into the mill casing, using hammer elements in common planes.
Figure 5:
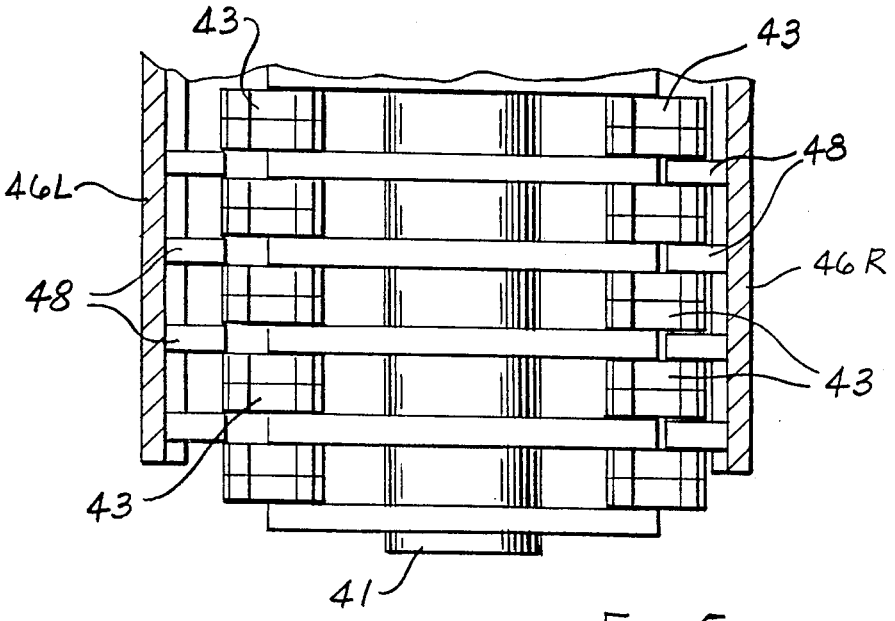
FIG. 5 is a fragmentary view taken along line 5—5 in FIG. 4 to show the arrangement of the shredding elements in relation to the rotor hammers.

Turning now to FIGS. 4 and 5, there is shown a modified embodiment of a hammer mill 40 having an axially elongated driven shaft 41 with mounting means 42 spaced along the axis of the shaft to receive groups of hammer elements 43 between spaced mounting means in operative positions on pivot rods 44. Hammer elements 43 between the mounting means 42 describe axially spaced circular paths 45, and there may be a plurality or group of hammer elements 43 in each path. For example, in FIG. 4 there are hammer elements 43 circumferentially spaced 120° apart and movable in the same path 45. It is possible to provide hammer elements 43 at 90° or 180° of circumferential spacing in each circular path, or at other angular spacing as desired.

Hammer rotors of the above character are mounted in the hammer mill 40 such that the tips of the hammer elements 43 swing or travel in a circular path 45. At each side of the path of travel 45 of the tips of the hammer elements 43 there is a breaker plate identified at 46R on the right side and at 46L on the left side. The breaker plates are pivoted at the upper margins on rods 47 so that the lower ends are rendered movable in arcuate paths toward and away from the tip path 45 of the hammer elements 43 under power operated motor means 25R and 25L respectively as seen in FIG. 2. The lower end of each breaker plate 46R and 46L is provided with a row of shredder teeth 48 arranged in spaced relation for the purpose of being able to intercept the paths of the group of the hammer elements in each plane of rotation and allow the hammer elements to pass without contact.

Looking at FIG. 5, the breaker plates 46R and 46L have been broken off in order to illustrate the positioning of the shredder teeth 48 arranged in a row adjacent the bottom of the breaker plate. In this view the rotary hammer assembly has the hammer elements 43 arranged in definite spaced rows to travel in circular paths to pass between the spaced shredder teeth 48. There is a working clearance established between the shredder teeth 48 and the hammer elements 43. As pointed out above, the hammer elements located in each of the axially spaced common circular paths spaced along the driven shaft 41 pass through the shredder teeth 48 so that any sheet material such as plastic bags or similar sheet material will be shredded by the function of the hammer elements 43 passing between the stationary shredder teeth 48.

The simplicity of drawing disclosure FIG. 5 shows only the shredder teeth 48 associated with the breaker plate 46R and 46L. It has been pointed out above that the shredder teeth 48 are provied so that sheet material will be shredded and not blind the rotor hammer elements 43 and prevent or upset the downdraft air flow effect which has been described in connection with the mill disclosed in FIG. 1. That same arrangement is seen in FIG. 4 at the spaces 49 which provide for air flow as well as placing the teeth 48 at the left side of the mill housing where the teeth can shred plastic sheet material.

If the present hammer mill with the downdraft function is to be subjected to the reduction of particulate trash that is free of sheet material, such as plastic bags, then the mill of FIG. 1 will be entirely satisfactory. It has been found that in many instances the incoming trash has a high percentage of plastic bags constituting a significant portion of the trash, and in those instances the downdraft mill disclosed in FIG. 4 will be required. The view of FIG. 4 includes the power operated cylinders 25R and 25L for positioning the breaker plates as described in connection with the disclosure of FIG. 2 so that the fan effect of the hammer elements 43 will be unaffected by the presence of the shredder teeth 48.

Having described presently prefered embodiments cf downdraft reversible hammer mills, it is understood that the disclosure may suggest other modifications of a character that will be within the scope of the foregoing description.

What is claimed is:

1. In a reversible hammer mill having a casing with a material inlet and an outlet, a rotary hammer assembly in said casing between said inlet and outlet, a pair of breaker plates in said casing embracing said rotary hammer assembly from opposite sides and movable toward and away from adjacent the circular path of travel of said hammer assembly, and grate bars circumscribing said rotary hammer assembly from said casing outlet and having opposite end bar elements extending into cooperative relation with said breaker plates, the improvement comprising:

means for creating a negative pressure at the casing inlet from the fan effect of said rotary hammer assembly and a positive pressure at said outlet, said means including breaker plate positioning means to advance one breaker plate toward said circular path of travel and to retract the second one of the pair of breaker plates from said circular path of travel; and said grate bar end bar elements having passages opening from said circular path of travel of said rotary hammer circle toward said casing outlet, the retracted one of said breaker plates opens said passage in said end bar and the advanced one of said breaker plates closes up to said other one of said pair of end bars for cooperating with said rotary hammers to pinch off the air flow in said other one of said end bars whereby a negative pressure is created at the casing inlet and a positive downdraft is created at the casing outlet.

2. In a reversible hammer mill having a casing formed with a material receiving inlet and a reduced material outlet, and means in the casing including a reversible drive shaft carrying hammers movable in paths which produce an air moving fan effect, breaker plates pivoted in the casing at opposite sides of the hammer paths with terminal ends which have paths of movement toward and away from the hammer paths, the improvement comprising:

(a) grate means in the casing outlet having opposite ends directed toward the path of movement of the terminal ends of the breaker plates, the grate means ends and the breaker plate terminal ends cooperating to define air flow passages opening around the ends of the grate means for air flow toward the casing outlet; and (b) means operably connected to the breaker plates to position the terminal ends of the breaker plates relative to the cooperating ends of the grate means such that a terminal end of one breaker plate is spaced from a cooperating end of the grate means to open an air flow passage around the grate means while the terminal of the opposite breaker plate is closed down on a cooperating end of the grate means to pinch off an air flow passage around the grate means, the spaced ends allowing air flow therethrough from the casing inlet and the closed down ends restricting air flow therethrough toward the casing inlet for drive shaft rotation of the hammers to produce air moving fan effect toward the open air flow passage around the grate means.

3. The improvement set forth in claim 2 wherein said means connected to said breaker plates comprises a system having separate actuators connected one to each of said breaker plates, and a common control associated with both of said actuators for effecting movement of said breaker plates concurrently.

4. The improvement set forth in claim 2 wherein the position of one of said breaker plates moved toward the path of travel of hammers effects an obstruction of the air flow, for the motion of the rotary hammers upwardly from said bottom outlet toward said inlet past said one breaker plate.

5. The improvement set forth in claim 2 wherein each of said grate means comprises a body having a plurality of flow passages separated by rib elements, said rib elements being located inwardly of the margins of said grate means whereby a flow passage is formed at the lower end of a breaker plate and the adjacent one of said end of the grate means.

6. In a reversible hammer mill having a casing formed with an upper material inlet and a lower processed material outlet, a drive shaft in the casing carrying a rotary hammer assembly operable between the material inlet and the processed material outlet, and the hammer assembly having hammer elements arranged in spaced groups with each group describing a circular path of travel, and a breaker plate operably mounted at each of the opposite sides of the rotary hammer assembly between the inlet and outlet with terminal ends which have paths of movement toward and away from the circular path of travel of the hammer assembly, the improved combination comprising:

(a) grate means in the casing material outlet having opposite ends directed toward the path of movement of the terminal ends of the breaker plates to cooperate therewith in defining air flow passages opening around the ends of the grate means;

(b) material shredding means carried by each of said breaker plates in position for extending inside the circular path of the rotary hammer assembly; and (c) means operably connected to said breaker plates in position for moving one of said breaker plates inwardly toward the circular path of travel of said hammer elements while retracting the opposite one so that an air flow passage is opened between the retracted one of said breaker plates and the processed material outlet while an air flow passage is pinched off betweeen the inwardly moved breaker plate terminal end and the cooperating end of the grate means, said material shredding means being held in position by the inwardly moved breaker plate in alignment with the spaces between groups of hammer elements for shredding material introduced at the upper inlet to said groups of hammer elements.

7. The improvement set forth in claim 6 wherein said material shredding means comprise individual teeth secured to the breaker plates in positions to project into the spaces between groups of hammer elements.

8. The improvement set forth in claim 6 wherein said material shredding means comprise individual teeth secured to the breaker plates and held by the breaker plates in stationary positions relative to the circular path of travel of the hammer elements such that the stationary teeth shred material carried by the hammer elements around in the casing in advance of reaching the processed material outlet.

9. A method for maintaining a rotary hammer mill operative for the reduction of trash containing sheet material of plastic and paper stock, the method consisting in the steps of:

(a) providing a casing having material inlet and outlet openings and supporting a rotor equipped with trash reducing hammers with tips which travel in a defined circular path;

(b) providing breaker plates spaced apart on opposite sides in the casing with the hammer rotor inbetween to receive material from the casing inlet;

(c) forming grate means for the casing outlet with air flow passages to allow air flow to pass around the grate means toward the casing outlet;

(d) moving the breaker plates into positions relative to the grate means such that with one breaker plate moved up to be adjacent the grate means and the tip circular path of the hammers and the other breaker plate moved to a position spaced from the grate means and the hammer tip circular path air flow occurs in the space created between the other breaker plate and the grate means; and (e) mounting sheet material shredding elements on each of the breaker plates in position such that the shredding elements on the breaker plate that is moved up to be adjacent the hammer tip circular path are located within the hammer tip circle for cooperating with the hammer elements to shred sheet material with trash reduction.

* * * * *